US009028232B2

(12) United States Patent
Schepp et al.

(10) Patent No.: US 9,028,232 B2
(45) Date of Patent: May 12, 2015

(54) INTERNAL GEAR PUMPS FOR A HYDRAULIC VEHICLE BRAKING SYSTEM

(75) Inventors: Rene Schepp, Waiblingen (DE); Norbert Alaze, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/982,867

(22) PCT Filed: Jan. 31, 2011

(86) PCT No.: PCT/EP2011/051310

§ 371 (c)(1),
(2), (4) Date: Oct. 14, 2013

(87) PCT Pub. No.: WO2012/103923

PCT Pub. Date: Aug. 9, 2012

(65) Prior Publication Data

US 2014/0030131 A1 Jan. 30, 2014

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 2/10*** | (2006.01) |
| ***F04C 15/00*** | (2006.01) |

(52) U.S. Cl.

CPC ..... *F04C 2/101* (2013.01); *F04C 15/0019* (2013.01)

(58) Field of Classification Search

USPC ..... 418/71, 126–129, 170

See application file for complete search history.

(56) References Cited

U.S. PATENT DOCUMENTS

| | | | | |
|---|---|---|---|---|
| 3,270,679 | A | 9/1966 | Sand et al. | |
| 3,486,459 | A | 12/1969 | Eltze | |
| 4,132,514 | A * | 1/1979 | Eckerle | 418/170 |
| 4,472,123 | A * | 9/1984 | Eckerle et al. | 418/126 |

FOREIGN PATENT DOCUMENTS

| | | | |
|---|---|---|---|
| DE | 196 13 833 | A1 | 10/1997 |
| DE | 10 2007 049 704 | A1 | 4/2009 |
| DE | 10 2009 047 643 | A1 | 6/2011 |
| JP | 2011-501023 | A | 1/2011 |

OTHER PUBLICATIONS

International Search Report corresponding to PCT Application No. PCT/EP2011/051310, mailed Nov. 8, 2011 (German and English language document) (5 pages).

* cited by examiner

*Primary Examiner* — Theresa Trieu

(74) *Attorney, Agent, or Firm* — Maginot, Moore & Beck LLP

(57) ABSTRACT

An internal gear pump for a slip-controlled hydraulic vehicle braking system includes a pinion, a ring gear, and a filler piece (sickle). The filler piece has an inner part extending in a curved manner in the peripheral direction and an outer part extending in a curved manner in the peripheral direction. The inner part and the outer part are interconnected in a hinged manner on the suction-sided ends. A leg spring is arranged between the inner and outer parts and is configured to separate the inner and outer parts and press against the tops of the teeth of the pinion and the tops of the teeth of the ring gear of the internal gear pump.

7 Claims, 2 Drawing Sheets

INTERNAL GEAR PUMPS FOR A HYDRAULIC VEHICLE BRAKING SYSTEM

BACKGROUND

This application is a 35 U.S.C. §371 National Stage Application of PCT/EP2011/051310, filed on Jan. 31, 2011, the disclosure of which is incorporated herein by reference in its entirety.

The disclosure relates to an internal gear pump for a hydraulic vehicle braking system having the features of the disclosure. Such internal gear pumps are used, instead of the piston pumps usually employed, in slip-controlled and/or externally powered vehicle braking systems and are often referred to, if not necessarily accurately, as return pumps.

Internal gear pumps are known. They comprise a pinion, that is, an externally toothed gear wheel, which is arranged in an internally toothed ring gear with which it meshes at a point on the circumference, or in a circumferential section. Through rotational driving of the pinion the ring gear is also driven in rotation and the internal gear pump delivers fluid in known fashion; in a hydraulic vehicle braking system it delivers brake fluid.

Opposite the circumferential section in which the pinion meshes with the ring gear, the internal gear pump has a crescent-shaped cavity between the pinion and the ring gear in which a filler piece is arranged.

The filler piece is normally pivoted about an axis parallel to the axis of the internal gear pump. Because of its curved shape, the filler piece is also referred to as a sickle, and internal gear pumps having such a filler piece are also referred to as sickle pumps. Tooth heads of the pinion bear against a concave inner side of the filler piece and tooth heads of the ring gear against a convex outer side of the filler piece. When the gear pump is driven, the tooth heads of the pinion and of the ring gear slide along the inner and outer sides of the filler piece respectively. The filler piece seals gaps between the pinion teeth and between the ring gear teeth along the circumference, so that fluid volumes are enclosed in the gaps between the teeth of the pinion and of the ring gear and are delivered by the rotational driving of the pinion and the ring gear from a pump inlet to a pump outlet. The pump inlet forms a suction side and the pump outlet a pressure side of the internal gear pump.

The patent DE 196 13 833 B4 discloses such an internal gear pump, the filler piece of which is divided in the circumferential direction and comprises an inner part referred to as the segment carrier and are outer part referred to as the segment. Leaf springs arranged between the inner part and the outer part press the inner part and the outer part radially apart and against the tooth heads of the pinion and of the ring gear in order to achieve a good abutment against the tooth heads and therefore a good sealing effect, which is a prerequisite for high efficiency of the internal gear pump. When the internal gear pump builds up a pressure during operation, this pressure acts on a gap or intervening space between the inner part and the outer part in a pressure-side region of the filler piece. In a central region an intermediate pressure acts on the intervening space between the inner part and the outer part, and in a suction-side region the suction pressure of the internal gear pump prevails in the intervening space between the inner part and the outer part. The pressure build-up during operation of the internal gear pump presses the inner part and the outer part of the filler piece of the known internal gear pump apart and against the tooth heads of the pinion and of the ring gear, additionally to the leaf springs, in order to improve the sealing effect.

The leaf springs arranged between the inner part and the outer part of the filler piece of the known internal gear pump are disposed transversely to the filler piece, that is, parallel to an axis of the internal gear pump. In order to achieve a significant spring travel, the springs must have a certain length, which determines a minimum width of the internal gear pump.

SUMMARY

The filler piece of the internal gear pump according to the disclosure has a leg spring the legs of which are disposed in the circumferential direction, although it is not critical that they lie exactly in the circumferential direction. The legs of the leg spring press the filler piece inwards against the tooth heads of the pinion and outwards against the tooth heads of the ring gear. An advantage of the disclosure is that a leg spring is sufficient to apply a force inwards and outwards to the filler piece over a major part of its length. A further advantage of the disclosure is that a width of the leg spring determines the (minimum) width of the internal gear pump, so that the disclosure makes possible a narrow internal gear pump. For a hydraulic vehicle braking system, the pinion and the ring gear have a width of, for example, approximately 2 mm. The disclosure makes possible narrower internal gear pumps the pinion and ring gear of which may have a width of 1 mm or less. A further advantage of the disclosure is simple assembly of the filler piece and installation thereof in the internal gear pump. The internal gear pump according to the disclosure has a high degree of fluid-tightness of the volumes enclosed between the teeth of the pinion and of the ring gear, and high volumetric efficiency. The leg spring of the internal gear pump according to the disclosure is, in particular, a leaf spring bent to form a U-shape, the legs of which are bent preferably in the same direction although not necessarily with the same curvature. However, a leg spring bent from wire or produced from solid material is also possible. The list is not definitive.

Advantageous configurations and developments of the disclosure are the subject matter of the dependent claims.

In a simple embodiment of the disclosure, the leg spring itself forms the filler piece, its outer leg bearing resiliently outwards against the tooth heads of the ring gear and its inner leg bearing resiliently inwards against the tooth heads of the pinion.

A yoke of the leg spring is preferably oriented towards an inlet, that is, a suction side of the internal gear pump. An application of pressure to the inner side of the leg spring from the pressure side of the internal gear pump is thereby achieved or at any rate made possible, pressing the legs of the leg spring, or the filler piece, inwards and outwards against the tooth heads of the pinion and of the ring gear.

The subject matter of the disclosure includes a multi-part filler piece comprising an inner part and outer part which are pressed apart and against the tooth heads of the pinion and of the ring gear by the leg spring arranged between them.

BRIEF DESCRIPTION OF THE DRAWINGS

The disclosure is explained in more detail below with reference to exemplary embodiments represented in the drawings. The two figures show two embodiments of internal gear pumps according to the disclosure in front views.

DETAILED DESCRIPTION

Figure 1:
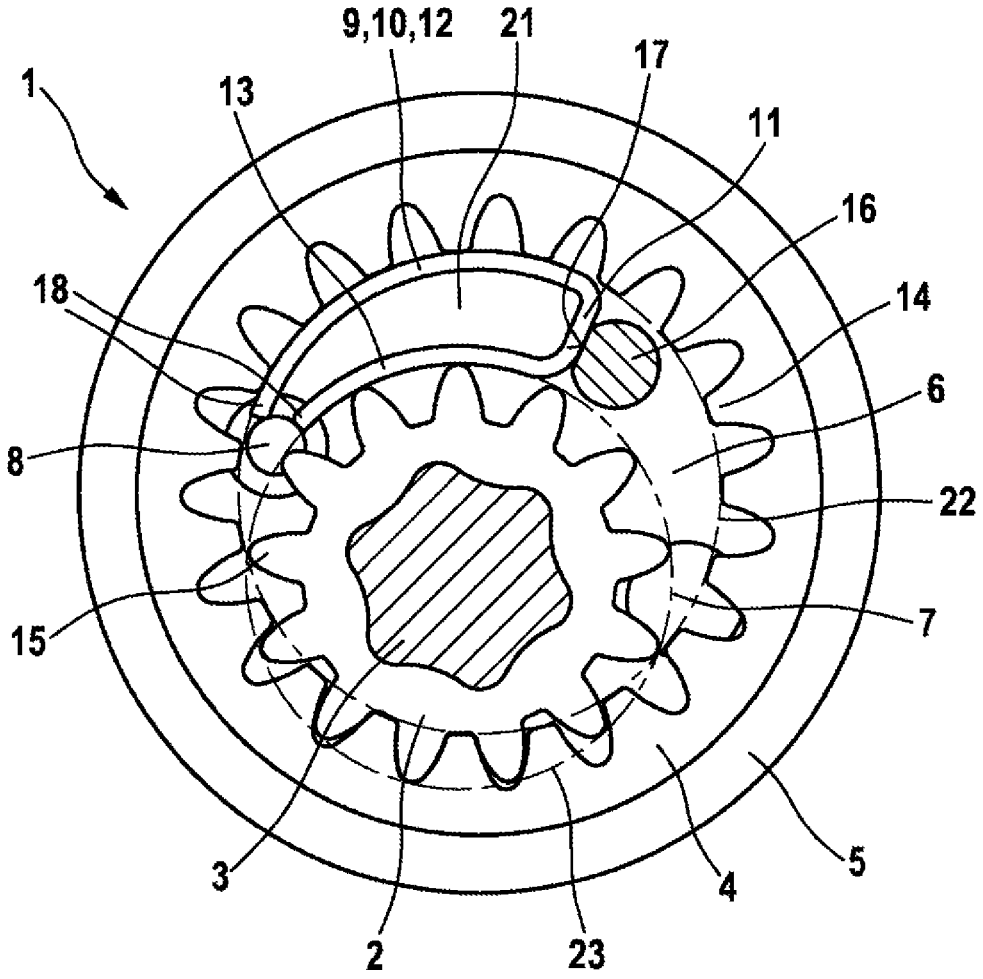

The internal gear pump 1 according to the disclosure represented in FIG. 1 is provided as a hydropump or so-called return pump in a hydraulic vehicle braking system having slip control. It comprises a pinion 2, that is, an externally toothed gear, which is arranged non-rotatably on a pump shaft 3. The pinion 2 is arranged eccentrically in an internally toothed ring gear 4 which is received rotatably in a tubular pump housing 5, although the pump housing may also have, for example, a polygonal configuration (not shown). Housing covers are omitted from the drawing so that the internal parts of the internal gear pump 1 are visible. The pinion 2 meshes with the ring gear 4 in a circumferential section; by rotational driving of the pinion 2 with the pump shaft 3 the ring gear 4 is also driven in rotation, so that the internal gear pump 1 delivers fluid, brake fluid in the exemplary embodiment represented, in a manner known per se. Opposite the circumferential section in which the pinion 2 meshes with the ring gear 4 the internal gear pump 1 has a crescent-shaped cavity 6 between the pinion 2 and the ring gear 4. In the region of an end of the cavity 6 a bore opens paraxially into the cavity 6 as the pump inlet 7, approximately opposite which a further bore opens into the cavity 6 as the pump outlet 8. The pump inlet 7 may also be understood as the suction side and the pump outlet 8 as the pressure side of the internal gear pump 1. A filler piece 9, in the form of a leg spring 10 in FIG. 1, is arranged in the cavity 6. In the embodiment of the disclosure which is represented and described, the leg spring 10 is a leaf spring bent to form a U-shape, the yoke 11 of which is located approximately centrally between the pump inlet 7 and the pump outlet 8. The legs 12, 13 of the leg spring 10 are curved according to respective tip circles 22, 23 of the ring gear 4 and the pinion 2 and extend from the yoke 11 in the direction of the pump outlet 8. The yoke 11 of the leg spring 10 is therefore oriented towards the pump inlet 7. The legs 12, 13 bear resiliently with a pretension against heads of teeth 14 of the ring gear 4 and heads of teeth 15 of the pinion 2. The legs 12, 13 of the leg spring 10 forming the filler piece 9 enclose fluid volumes in gaps between the teeth 14 and of the ring gear 4 and between the teeth 15 of the pinion 2, so that driving of the pinion 2 and of the ring gear 4 in rotation causes fluid to be delivered from the pump inlet 7 to the pump outlet 8.

For positional fixing, the leg spring 10 forming the filler piece 9 bears in the circumferential direction and in the direction of the pump inlet 7 against an abutment pin 16 which passes paraxially through the housing 5 and is received in blind bores in the housing covers (not shown) or in a housing front wall (not shown). In order to improve the support, the abutment pin 16 has a flattened portion 17 against which the yoke 11 of the leg spring 10 bears.

The leg spring 10 is open between the free ends 18 of the legs 12, 13. The free ends 18 and the open end of the leg spring 10 are located in the region of the pump outlet 8, that is, of the pressure side of the internal gear pump 1. An intervening space 21 between the legs 12, 13 of the leg spring 10 is thereby charged with pressurized brake fluid during operation of the internal gear pump 1, pressing the legs 12, 13 outwards additionally to the spring force of the leg spring 10 and thereby improving the abutment of the legs 12, 13 of the leg spring 10 against the heads of the teeth 14 of the ring gear 4 and of the teeth 15 of the pinion 2. A sealing effect of the abutment of the legs 12, 13 against the heads of the teeth 14, 15 of the ring gear and of the pinion 2 is thereby improved with increasing delivery pressure of the internal gear pump 1. This improves the efficiency of the internal gear pump 1.

Figure 2:
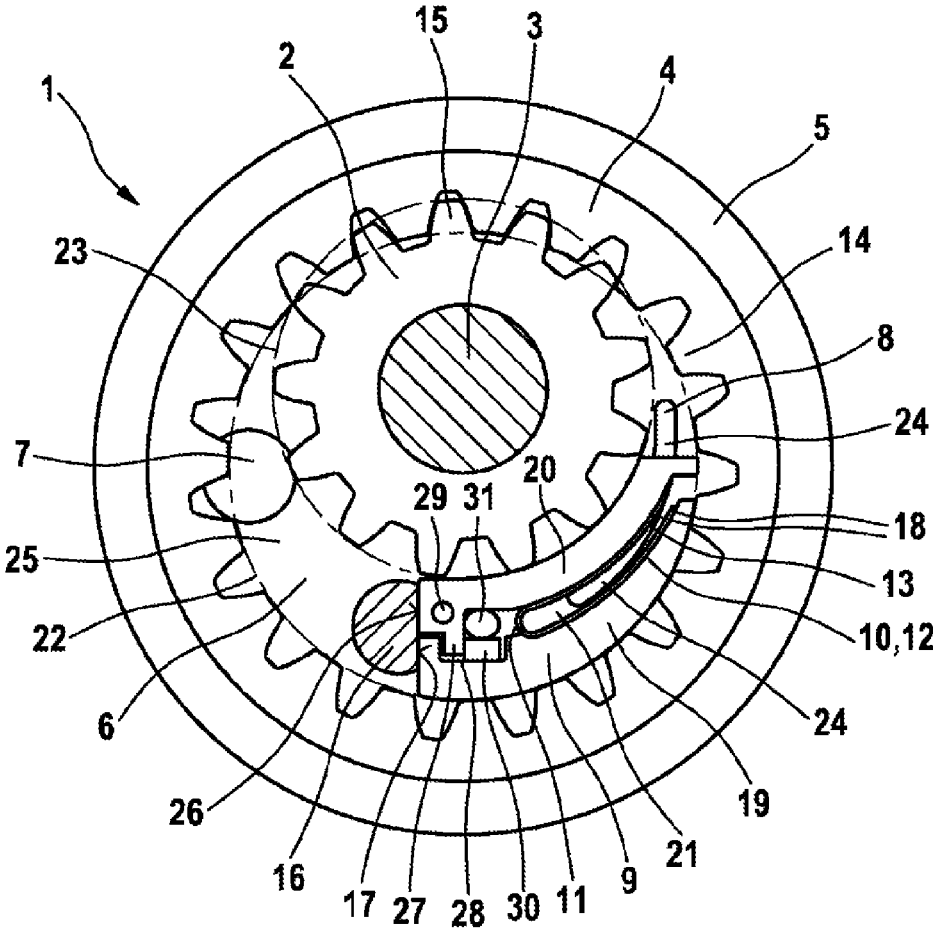

Like the internal gear pump 1 of FIG. 1, the internal gear pump 1 of FIG. 2 comprises a pinion 2 which is arranged non-rotatably on a pump shaft 3 and eccentrically in a ring gear 4 with which it meshes in a circumferential section. The structure and functioning of the internal gear pump 1 of FIG. 2 coincide to that extent with the structure and functioning of the internal gear pump 1 represented in FIG. 1. To avoid repetition, the explanations relating to FIG. 1 are referred to in a supplementary manner in the explanation of FIG. 2. Like components are denoted by the same reference numerals in FIGS. 1 and 2.

In deviation from FIG. 1, the filler piece 9 in FIG. 2 is of multi-part configuration, comprising an outer part 19 and an inner part 20 which extend in an arcuate manner in the circumferential direction and between which an intervening space 21 is located, which is also disposed in an arcuate manner in the circumferential direction and in which the leg spring 10 is arranged. Because of its curved overall shape the filler piece 9 may also be referred to as a sickle; its inner part 20 may also be referred to as the segment carrier and its outer part 19 as the segment. An outer side of the outer part 19 is curved in an arc of a circle conforming to the tip circle 22 of the ring gear 4. An inner side of the inner part 20 has a concave curvature conforming to a tip circle 23 of the pinion 2. Heads of the teeth 14 of the ring gear 4 bear sealingly against the outer side of the outer part 19 of the filler piece 9 and heads of the teeth 15 of the pinion 2 bear sealingly against the inner side of the inner part 20 of the filler piece 9. The leg spring 10 arranged between the inner part 20 and the outer part 19 presses the inner part 20 and the outer part 19 apart and thereby presses the outer part 19 outwards in sealing abutment against the heads of the teeth 14 of the ring gear 4 and the inner part 20 inwards in sealing abutment against the heads of the teeth 15 of the pinion 2.

In order to improve the sealing effect as the delivery pressure of the internal gear pump 1 rises, the intervening space 21 between the inner part 20 and the outer part 19 is charged with pressurized brake fluid from the pump outlet 8. The pressurization presses the inner part 20 and the outer part 19 apart, additionally to the leg spring 10, and increases the sealing effect at the heads of the teeth 15, 14 of the pinion 2 and the ring gear 4 as the delivery pressure of the internal gear pump 1 rises. The volumetric efficiency of the internal gear pump 1 is improved thereby. The pressure is applied through an open end of the intervening space 21 at the pump outlet 8 and/or through a pressure field 24. The leg spring 10 is slightly narrower than the inner part 20 and the outer part 19 of the filler piece 9. The pressure of the pump outlet 8 therefore also acts on a sealing element 30 and an adjustment element 31 which are arranged on a pump outlet side of the yoke 11 of the leg spring in the intervening space 21 between the inner part 20 and the outer part 21 of the filler piece 19 and are explained below. The pressure field 24 is a groove-shaped depression in an axial disk 25. The pressure field 24 extends in the circumferential direction from the pump outlet 8 to a longitudinally central region of the intervening space 21 between the inner part 20 and the outer part 19 of the filler piece 9. Axial disks 25 which seal against side faces of the ring gear 4 and the pinion 2 are arranged on both sides of the internal gear pump 1. The axial disks 25 are located between the housing covers (not shown) on one side and the ring gear 4 and the pinion 2 on the other.

End faces 26 of the inner part 20 and of the outer part 19 facing towards the pump inlet 7 on the suction side are flat and are disposed approximately radially. They bear against the flattened portion 17 of the abutment pin 16. The end faces 26 are located approximately at a center of the cavity 6 somewhat closer to the pump inlet 7 than to the pump outlet 8.

In FIG. 2 also, the yoke 11 of the leg spring 10 is oriented towards the suction side, that is, towards the pump inlet 7, while the open end of the leg spring 10 and the free ends 18 of the legs 12, 13 of the leg spring 10 are oriented towards the pump outlet 8.

At their ends on the suction side the inner part 20 and the outer part 19 are articulated to one another; for this purpose the inner part 20 has an outward projection 27 which engages in a recess 28 on the inner side of the outer part 19. The inner part 20 is secured with a pin 29 which passes transversely through it close to its end on the suction side and is retained in the housing covers (not shown). The inner part 20 pivots about the pin 29.

In the region of its end on the suction side the filler piece 9 is sealed with a sealing element 30 and an adjustment element 31. In the embodiment of the disclosure represented, the sealing element 30 has a rectangular cross section and fits into the recess 28 of the outer part 19 in which the projection 27 of the inner part 20 also engages. The sealing element 30 extends transversely, that is paraxially, through the cavity 6 of the internal gear pump 1 and bears with its end faces sealingly against the axial disks 25, which bear sealingly against the side faces of the pinion 2 and of the ring gear 4 and close the cavity 6 laterally. On the outside the sealing element 30 bears against an inner side of the outer part 19, and on the inside against the projection 27 of the inner part 20, in the direction of the suction side of the internal gear pump 1. The sealing element 30 consists of a sealing material with very high resistance to extrusion. Resistance to extrusion means the resistance of the sealing element 30 to plastic deformation when subjected to high pressure, in particular, resistance to creeping of the sealing element 30 into a gap. The internal gear pump 1 can generate a pressure of up to 300 bar, which acts on the sealing element 30; the sealing element 30 must withstand this pressure. An elastomer does not withstand such a pressure; the sealing element 30 therefore consists, for example, of PTFE (polytetrafluoroethylene), the elasticity of which is, however, limited. For this reason the adjustment element 31, the elasticity of which is greater than that of the sealing element 30, is additionally provided. The adjustment element 31 consists, for example, of an elastomer such as EPDM (ethylene-propylene-diene rubber). The adjustment element 31 is cylindrical and is arranged radially inside the sealing element 30 in a channel (inside corner) on the outer side of the inner part 20 at the transition to the projection 27. In this region there is no gap into which the adjustment element 31 could creep. The adjustment element 31 presses the sealing element 30 elastically outwards against the outer part 19. The end faces of the adjustment element 31 bear sealingly against the axial disks 25 and its circumference bears against the outer side of the inner part 20 and against the projection 27. The sealing element 30 and the adjustment element 31 jointly seal the filler piece 9 at its end on the suction side laterally with respect to the axial disks 25, and seal the inner part 20 and the outer part 19 of the filler piece 9 with respect to one another.

The invention claimed is:

1. An internal gear pump for a hydraulic vehicle braking system, comprising:

an internally toothed ring gear;

an externally toothed pinion arranged eccentrically in the ring gear and configured to mesh with the ring gear in a circumferential section, the pinion and the ring gear forming a crescent-shaped cavity opposite the circumferential section in which the pinion meshes with the ring gear; and a filler piece arranged in the cavity, the filler piece having an inner side on which heads of teeth of the pinion bear against and an outer side on which heads of teeth of the ring gear bear against, wherein the filler piece comprises a leg spring having legs disposed in the circumferential direction, the legs being configured to urge the filler piece inwards and outwards against the heads of the teeth of the pinion and the heads of the teeth of the ring gear, wherein the filler piece comprises an inner part having an inner side that bears against the heads of the teeth of the pinion, and an outer part having an outer side that bears against heads of the teeth of the ring gear, wherein the leg spring is arranged between the inner part and the outer part of the filler piece and is configured to press the inner part and the outer part apart, and wherein the filler piece has a sealing element which is arranged between the inner part and the outer part and which is configured to one or more of bear sealingly against the inner part and/or the outer part and seal axially.

2. The internal gear pump as claimed in claim 1, wherein the leg spring forms the filler piece and its legs bear against the heads of the teeth of the pinion and the heads of the teeth of the ring gear.

3. The internal gear pump as claimed in claim 1, wherein a yoke of the leg spring is oriented towards a suction side of the internal gear pump.

4. The internal gear pump as claimed in claim 1, wherein an intervening space formed between the inner part and the outer part of the filler piece is charged with fluid which is pressurized by the internal gear pump during operation of the internal gear pump.

5. The internal gear pump as claimed in claim 1, wherein the inner part and the outer part are articulated to one another.

6. The internal gear pump as claimed in claim 1, wherein the filler piece has an elastic adjustment element arranged between the inner part and the sealing element or between the outer part and the sealing element, the elastic adjustment element being configured to (i) press the sealing element outwards against the outer part or inwards against the inner part, (ii) bear sealingly against the inner part and the sealing element or against the outer part and the sealing element, and (iii) seal axially.

7. The internal gear pump as claimed in claim 6, wherein the adjustment element has greater elasticity than the sealing element and/or the sealing element has greater resistance to extrusion than the adjustment element.

* * * * *